US005977531A

United States Patent [19]

Pfister et al.

[11] Patent Number: 5,977,531

[45] Date of Patent: Nov. 2, 1999

[54] MICROWAVE INDUCED THERMAL INVERSION PACKAGING

[76] Inventors: Dennis M. Pfister, 43 K. Kostka Dr., North Attleboro, Mass. 02760; Charles M. Byrd, 365 Talbot Ave. Apt. T - 14, Pacifica, Calif. 94044

[21] Appl. No.: 08/893,218

[22] Filed: Jul. 15, 1997

[51] Int. Cl.[6] ..... H05B 6/80

[52] U.S. Cl. ..... 219/725; 219/728; 219/729; 219/748

[58] Field of Search ..... 219/685, 702, 219/704, 709, 712, 728, 730, 745, 725, 748, 744, 750, 756, 759; 99/419–421 V, DIG. 14, 448

[56] References Cited

U.S. PATENT DOCUMENTS 4,020,188 4/1977 Forkner .
4,233,325 11/1980 Slangan et al. .
4,460,814 7/1984 Diesch et al. .
4,789,552 12/1988 Speakman et al. .
4,866,234 9/1989 Keefer .
4,888,459 12/1989 Keefer .
4,896,011 1/1990 Trucks ..... 219/725
4,992,636 2/1991 Namiki et al. .
5,322,984 6/1994 Habeger, Jr. et al. .
5,493,103 2/1996 Kuhn ..... 219/730
5,582,854 12/1996 Nosaka et al. .
5,685,217 11/1997 Kreitzer ..... 99/419

*Primary Examiner*—Tu Ba Hoang
*Attorney, Agent, or Firm*—Henry C. Query, Jr.

[57] ABSTRACT

The present invention is directed to a device for facilitating the heating of a food product having an interior and an exterior, the device comprising an antenna for receiving microwave energy generated by a microwave source, such as a microwave oven, and converting the microwave energy into an electric current, and at least two probes in contact with the antenna and the interior of the food product for directing the current into the interior of the food product, whereby the interior of the food product is resistively heated.

20 Claims, 4 Drawing Sheets

MICROWAVE INDUCED THERMAL INVERSION PACKAGING

BACKGROUND OF THE INVENTION

The present invention is directed to a device for facilitating the heating of food products in a microwave oven. More particularly, the invention is directed to such a device which converts the microwave energy into electric current and directs the current across the core of the food product to heat the food product from the inside out.

Conventional conductive and convective methods of cooking or warming food products heat the food products from the outside in. This is also true of microwave cooking, wherein the microwave energy is attenuated from the outside to the inside of the food product. Consequently, certain food products are sometimes overcooked on the outside while the inside remains undercooked. In addition, it is difficult using these prior art heating methods to obtain a food product which is unheated on the outside but heated on the inside.

SUMMARY OF THE INVENTION

According to the present invention, these limitations are overcome by providing a device for facilitating the heating of a food product having an interior and an exterior, the device comprising an antenna for receiving microwave energy generated by a microwave source, such as a microwave oven, and converting the microwave energy into an electric current, and at least two probes in contact with the antenna and the interior of the food product for directing the current into and across the interior of the food product, whereby the interior of the food product is resistively heated. In one embodiment of the invention, the antenna is comprised of a package for the food product which is constructed of an electrically conductive material, such as foil, and the probes form a portion of the package.

In the present invention, the package may be constructed either entirely or partially of the electrically conductive material. In the former case, the invention is particularly suited to creating a frozen confection having a heated core. The confection may comprise, for example, an outer layer of ice cream surrounding an inner core of chocolate which is separated from the ice cream by an edible waffle material. During packaging of this confection, the package is placed entirely around the ice cream with the probes in contact with opposite ends of the chocolate core. While heating the confection in a microwave oven, the package will receive the microwave energy and convert it into an electric current, and the probes will direct the current into and across the chocolate core. Since the core presents a substantial effective resistance to the current, the electrical energy of the current will be converted into heat which will heat the core. This process thus in effect converts the core into a resistance heater. At the same time, the package will shield the ice cream from the microwave energy and the waffle will insulate the ice cream from the core to maintain the ice cream in a frozen state. The resulting confection will be frozen on the outside and heated, or melted, on the inside.

In the case where the package is constructed partially of the electrically conductive material, the invention is especially useful in heating the interior of a food product during conventional microwave cooking of the food product. In this embodiment, the package comprises a number of continuous electrically conductive strips formed in or on a microwave transparent material. The strips are in contact with the probes, which during packaging are inserted through the exterior of the food product into the interior thereof. During heating of the food product in a microwave oven, a portion of the microwave energy will be received by the strips and converted into and across an electric current which is directed into the interior of the food product, while the remainder of the microwave energy will pass through the package directly to the exterior of the food product. Applying the current into the interior of the food product will, in effect, convert the portion of the food product between the probes into a resistance heater. Thus, the current will resistively heat the food product from the inside out while the remainder of the microwave energy will heat the food product from the outside in to ensure that the entire food product is heated uniformly.

These and other objects and advantages of the invention will be made more apparent by the following detailed description, with reference to the accompanying drawings.

In the drawings, certain elements that are described hereafter as being overlapped or contacting have been shown slightly seperated for purposes of clarity.

BRIEF DESCRIPTION OF THE DRAWINGS

1

DETAILED DESCRIPTION OF THE PREFERRED EMBODIMENTS

The present invention relies on the phenomenon that if an appropriately dimensioned conductor, such as a wire, is placed in an electromagnetic field, the electromagnetic waves will induce a current flow in the conductor. Consequently, if the conductor is connected across a resistive element, the electrical energy will be converted into heat.

Many food products present sufficient effective resistance to generate substantial heat in the presence of an electric current. Accordingly, the present invention takes advantage of the above-described phenomenon by receiving the microwave energy generated by a microwave source, such as a conventional microwave oven, converting the microwave energy into an electric current and directing the current into and across a food product in order to resistively heat the interior of the food product. Due to the substantial effective resistance of certain food products, the resulting voltage across the food product will be sufficiently high to warm or melt the interior of the food product in relatively short order. The invention therefore not only permits the creation of food products which were difficult if not impossible to make in the past, such as a frozen confection having a heated inner core, but it also allows conventional food products to be more thoroughly heated in a standard microwave oven.

In general terms, the invention includes an antenna for receiving the microwave energy and converting it into an electric current, and two probes coupled to the antenna and connected across the product for conducting the current into and across the interior of the product. The optimum length of the food product is preferably equal to or greater than one-quarter the wavelength of the microwaves generated by the microwave source. Consequently, when the probes are place at opposite ends of the food product, the microwave energy received by the device of the present invention will produce a voltage across the probes which is sufficient to heat the interior of the food product.

Figure 1:
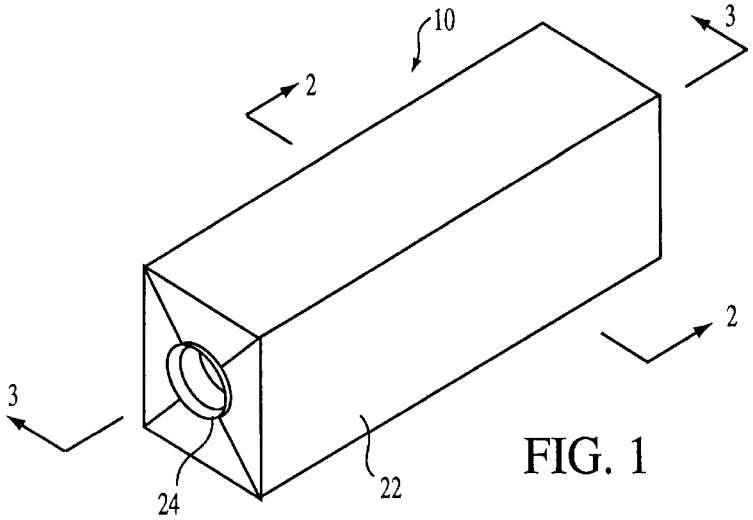
FIG. 1 is a perspective view of a frozen confection shown wrapped in a package constructed according to one embodiment of the present invention.
Figure 2:
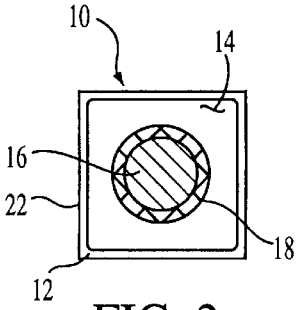
FIG. 2 is a transverse cross-sectional view of the confection and package taken along line 2—2 of FIG. 1.
Figure 3:
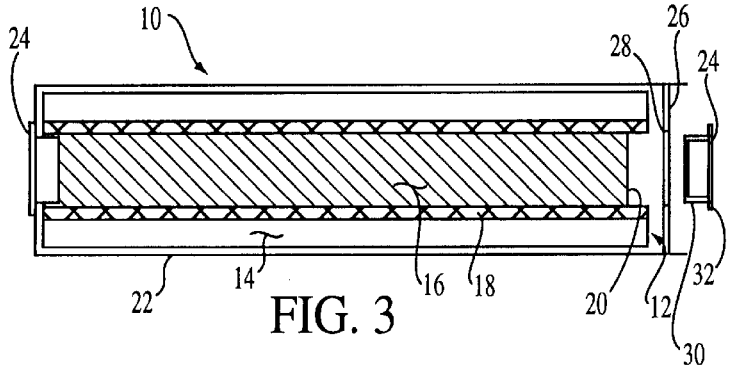
FIG. 3 is a partially exploded, longitudinal cross-sectional view of the confection and package taken along line 3—3 of FIG. 1.

Referring to FIGS. 1 through 3, one embodiment of the present invention is shown in the form of a package 10 for an exemplary frozen confection 12. Although this embodiment of the invention will be described with reference to the exemplary confection 12, it should be understood that the invention could be used with any food product having an edible exterior surrounding an edible interior. The confection 12 includes an outer layer of ice cream 14 surrounding an inner core of chocolate 16 which is separated from the ice cream 12 by an insulating cylinder 18 comprised of an edible waffle material. Although other configurations are possible, the confection 12 is depicted as being somewhat elongated, with the core 16 positioned along the longitudinal axis of the confection 12. In addition, the ends of the core 16 are relieved to form a recess 20 in each end of the cylinder 18.

The package 10 comprises a wrapper 22 and two probes 24. The wrapper 22 is wrapped around the confection 12 in a conventional fashion and is constructed of an electrically conductive material. Suitable materials for the warpper 22 are metallic foils, such as aluminum foil, and metalized plastic foils, such as metalized Polyethylene and metalized Polypropylene. If the wrapper 22 is constructed of a single-ply conductive material, the package 10 also preferably includes an insulating disc 26 positioned between each end of the confection 12 and the wrapper 22. Each disc 26 is preferably made of an insulating paper or plastic material and includes a hole 28 to accommodate a corresponding probe 24. The wrapper 22 could also be constructed of a two-ply material having a conductive outer layer bonded to an insulating inner layer, in which case the insulating discs 26 would not be required.

In the embodiment depicted in FIGS. 1 through 3, the probes 24 extend through the wrapper 22 and contact the core 16 directly. In this embodiment, each probe 24 preferably comprises a plug portion 30 extending from an annular lip 32. Each probe 24 is configured so that the plug portion 30 is snugly received in a corresponding recess 20, the end of the plug portion 30 contacts the core 16 and the lip 32 engages the wrapper 22. In addition, the probes 24 are constructed of an electrically conductive material, such as metallized plastic. In this manner, electric current can be conducted from the wrapper 22 through the probes 24 to the core 16.

Accordingly, when the package 10 and confection 12 are exposed to microwave energy, the wrapper 22 will function as an antenna and receive the microwave energy, convert it into electric current and direct the current toward the probes 24. The probes 24 then direct the current into and across the core 16, where it is converted into heat to resistively heat the core 16. The wrapper 22 also shields the ice cream layer 14 from the microwave energy and the waffle cylinder 18 insulates the ice cream layer 14 from the core 16 to maintain the ice cream layer 14 in a frozen state. In addition, the probes 24 will maintain the partially melted core 16 within the waffle cylinder 18 to ensure that the core will continue to conduct the current and not leak out and melt the ice cream layer 14. Consequently, the resulting confection will have a frozen outer layer of ice cream and a heated inner core of chocolate.

The present invention is capable of generating a sufficiently high voltage between the probes 24 to heat the core 16 in a relatively short time. Furthermore, the resulting current is so low that the contact points between the probes 24 and the core 16 need not be robust. For example, if a confection 12 having a chocolate core 16 is heated in a conventional 900 W microwave oven, approximately 600 W of power may be coupled to the package 10. If an appropriate chocolate is selected which has an effective resistance of about 1 MΩ, the resulting voltage across the probes 24 will be approximately 24,000 V while the current will be only about 24 mA. This high voltage, low current signal is usually sufficient to melt the core 16 in under 1 minute.

Figure 4:
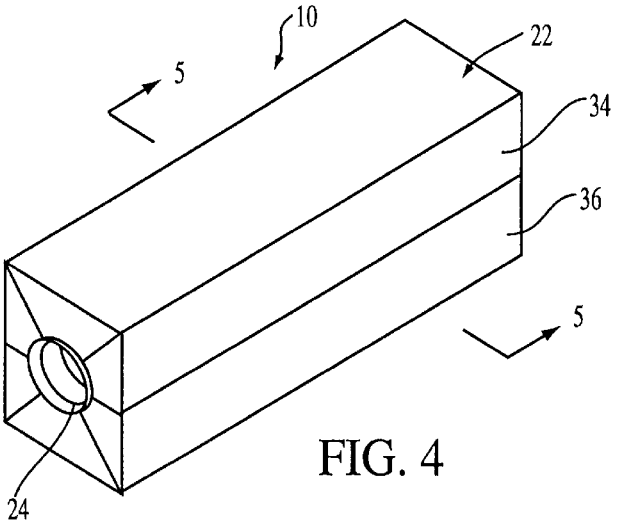
FIG. 4 is a perspective view of a frozen confection shown wrapped in a package constructed according to another embodiment of the present invention.
Figure 5:
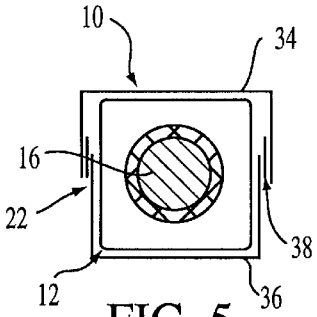
FIG. 5 is a partially exploded, transverse cross-sectional view of the confection and package taken along line 5—5 of FIG. 4.

In designing the wrapper 22, standard RF design techniques are employed to ensure that the current is directed toward the probes 24. If ,due to the shape of the food product, the wrapper 22 cannot be configured to ensure that the current is directed toward the probes, the package 10 may be provided with additional means to achieve this result. For example, referring to FIGS. 4 and 5, the package 10 may comprise a wrapper 22 having a first longitudinal sheet 34, a second longitudinal sheet 36 and an insulating strip 38 connected between the first and second sheets 34, 36. In this manner, the current is conveyed longitudinally by the sheets 34, 36 to the probes 24 and is prevented from flowing transversely by the insulating strip 38.

Although in the previous embodiments the current is conducted into the core 16 by the probes 24, the wrapper 22 itself may be adapted to perform this function. For example, the wrapper 22 may be sized to completely cover the ends of the confection 12. If the core 16 extends to the ends of the confection 12, the wrapper 22 will contact the core 16 and therefore conduct the current into the core 16. If, however, the confection 12 is provided with recesses 20, as depicted in FIG. 3, the probes 24 may be configured to merely push the ends of the wrapper 22 into the recesses 20 and into contact with the core 16. While the probes 24 of this variation include a plug portion which is preferably configured to fit snugly within the recess 20, the probes need not include an annular lip and do not need to be constructed of an electrically conductive material.

Figure 6:
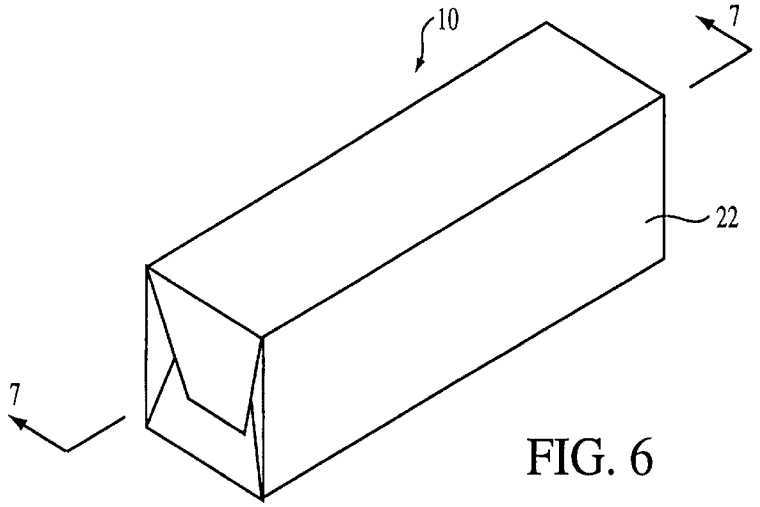
FIG. 6 is a perspective view of a frozen confection shown wrapped in yet another package constructed according to the present invention.
Figure 7:
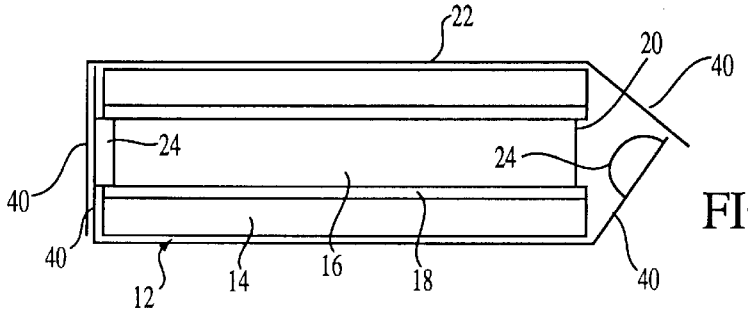
FIG. 7 is a partially exploded, longitudinal cross-sectional view of the frozen confection and package taken along line 7—7 of FIG. 6.

The probes 24 may also be combined with the wrapper 22. Referring to FIGS. 6 and 7, each probe 24 is shown to comprise a semi-spherical bubble which is incorporated into a corresponding end flap 40 of the wrapper 22. The bubble probes 24 may be formed by injecting air between successive layers of the wrapper 22. Alternatively, the bubble probes 24 may be constructed separately and then adhered to the end flaps 40 using an appropriate adhesive or other suitable means. If constructed separately, the bubble probes 24 are made of an electrically conductive material preferably similar to the material used to make the wrapper 22. In either case, the bubble probes 24 are preferably somewhat compressible such that, when the end flaps 40 are sealed over the ends of the confection 12, the bubble probes 24 will contact the core 16 and seal against the waffle cylinder 18, as shown in the left hand side of FIG. 7.

Figure 8:
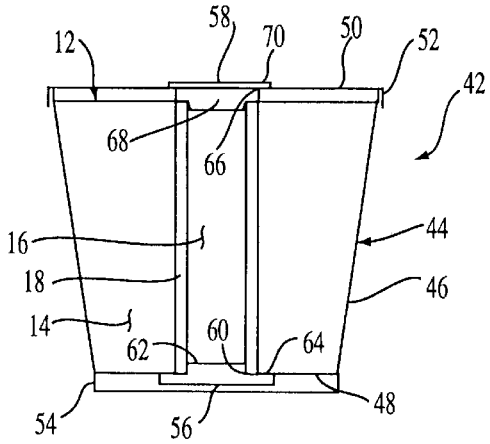
FIG. 8 is a cross-sectional view of a frozen confection shown in another embodiment of a package of the present invention.

Referring to FIG. 8, another embodiment of the present invention is shown in the form of a package 42 for a frozen confection similar to the confection 12. In this embodiment, the package 42 comprises a container 44 having a preferably conical side wall 46 and a bottom 48 which is formed integral with or affixed to the side wall 46 in a conventional fashion. The container 44 also comprises a removable lid 50 having an annular lip 52 which sealingly engages the top of the side wall 46. The container 44 may be provided with an annular ridge 54 extending from the bottom 48 to space the bottom 48 from a supporting surface (not shown).

The package 44 also comprises a pair of probes 56, 58 extending through the bottom 48 and the lid 50, respectively, and contacting the core 16 of the confection 12. Although the probes 56, 58 may be similar, the probe 56, which extends through a corresponding hole 60 formed in the bottom 48, preferably comprises a rigid plug portion 62 extending from an annular lip 64 which in turn is adhered to the bottom 48. The probe 58, which extends through a corresponding hole 66 formed in the lid 50, preferably includes a compressible plug portion 68 extending from a lip 70 which is adhered to the lid 50.

In this embodiment, the side wall 46 and the bottom 48 of the container 44 are preferably made of a paper or cardboard material having an outer electrically conductive layer, such as a metallic foil outer covering, while the lid 52 is preferably made entirely of an electrically conductive material, such as aluminum foil. Thus, an electrically conducting path is formed between the side wall 46 and the lid 50 through the lip 52. The probes 56, 58 are also made of an electrically conductive material, such as any of the materials discussed above. The lips 64, 70 contact the electrically conductive layer of the bottom 48 and the lid 50, respectively, to form an electrically conducting path between the container 44 and the probes 56, 58. Thus, when exposed to microwave energy, the microwaves will be received by the container 44 and directed by the probes 56, 58 into the core 16.

Standard RF design techniques are used to design the container 44 to optimally receive the microwaves and direct the current to the probes 56, 58. For example, the side wall 46 may be provided with one or more longitudinal insulating strips to ensure that the current is directed toward the bottom 48 and the lid 50. In addition, the bottom 48 and the lid 50 may each be provided with one or more insulating strips radiating from the holes 60, 66 to ensure that the current is directed to the probes 56, 58.

Furthermore, although the probes 56, 58 are described in the FIG. 8 embodiment as being separate elements, the probes could actually form part of the bottom 48 and the lid 58. For example, the probe 56 may be formed integrally with the bottom 48, with the plug portion 62 protruding from the bottom 48. Alternatively, if the core 16 extends completely to the bottom of the confection 12, the probe 56 may merely comprise an electrically conductive area formed on the bottom 48 in contact with the electrically conductive outer layer. Furthermore, the probe 58 could be similar to the bubble probe 24 described in reference to FIG. 7. Other configurations of the probes 56, 58 are also contemplated by the present invention.

Figure 9:
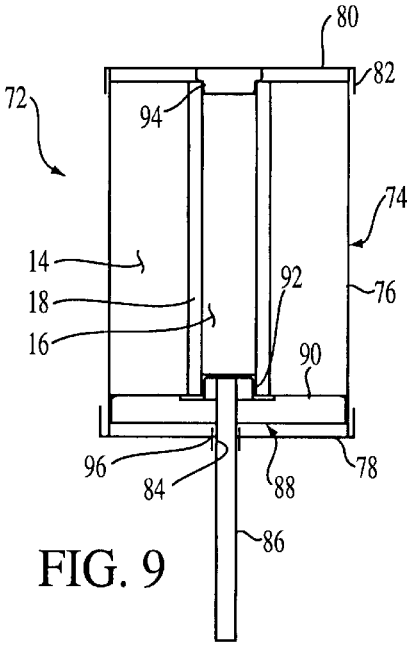
FIG. 9 is a cross-sectional view of a frozen confection shown in still another embodiment of a package of the present invention.

Referring now to FIG. 9, another embodiment of the present invention is shown in the form of a package 72 for a frozen confection similar to the confection 12. In this embodiment, the package 72 comprises a container 74 having a preferably cylindrical side wall 76, a bottom 78 formed integrally with or attached to the side wall 76 using conventional means, and a removable lid 80 having an annular lip 82 which sealingly engages the side wall 76. The bottom 78 comprises a central hole 84 through which extends a rod 86 of a plunger member 88. The plunger member 88 includes a platform 90 for supporting the confection 12. The platform 90 is connected to the rod 86 and is configured to be slideably received in the cylindrical side wall 76.

The package 72 includes a probe 92 which extends from the platform 90 and contacts the core 16. While the platform 90 is preferably made of a non-conducting material, such as plastic, the probe 92 and the rod 86 are constructed of an electrically conductive material, such as metalized plastic. The package 72 also includes a probe 94 which extends from the lid 80 and contacts the core 16. The lid 80 and probe 94 may take the form of the lid 50 and probe 58 discussed in the previous embodiment.

The side wall 76 and bottom 78 are preferably made of the same electrically conductive material of which the side wall 46 and bottom 48 of the previous embodiment are made. In addition, the bottom 78 preferably includes a contact ring 96 which snugly engages the rod 86. The contact ring 96 is made of a suitable conductive material in order to provide an conducting path between the bottom 78 and the rod 86. Alternatively, the hole 84 in the bottom 78 may be adapted to allow the current to be conducted directly from the bottom 78 to the rod 86.

When exposed to microwave energy, the package 72 will receive the microwaves, convert them into current and direct the current to the probes, which in turn will couple the current into and across the core to heat the core. After the core has been sufficiently heated, the lid 80 is removed and the rod 86 is urged upward to make the confection 12 accessible for eating. Standard RF design techniques, such as any of the means discussed above, may be used to ensure that the current is optimally received and directed to the core 16.

It should be apparent from the above description that the invention of the previous embodiments is useful for creating a unique confection 12. The invention enables the confection 12 to simultaneously comprise a frozen outer layer 14 and a heated, or melted, inner core 16. While the outer layer 14 may be made of any edible food product, the confection 12 preferably comprises an outer layer which is best served frozen or cold. In addition, although the exemplary confection 12 has been described herein as having a chocolate core 16, any edible food product which is best served warm or which melts at room temperature may be used. Examples of such a food product are the toppings traditionally used with ice cream, such as fudge, caramel, marshmallow and raspberry syrup. Furthermore, although the confection 12 need not include an insulating cylinder 18, more favorable results are obtained when the outer layer 14 is insulated from the heated core 16. The insulating cylinder 18 may be made of any suitable insulating food product, such as the waffle material mentioned above, cookies or dough.

While the package of the previous embodiments has been described as comprising a wrapper or container that is constructed of an electrically conductive material which substantially shields the food product from the microwave radiation, the present invention is also particularly useful with wrappers or containers that permit a portion of the radiation to pass through to heat the food product from the outside in.

Figure 10:
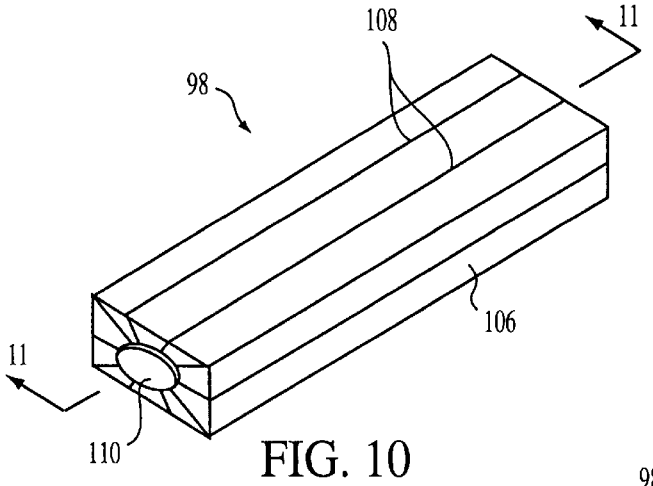
FIG. 10 is a perspective view of a food product shown wrapped in another embodiment of a package of the present invention.
Figure 11:
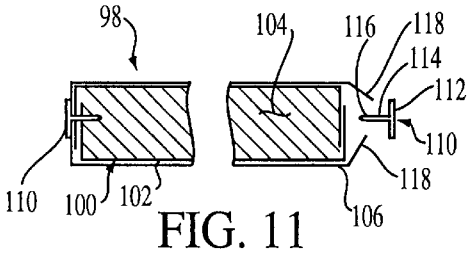
FIG. 11 is a partially exploded, longitudinal cross-sectional view of the food product and package taken along line 11—11 of FIG. 10.

Referring to FIGS. 10 and 11, a package 98 constructed in accordance with this embodiment of the invention is shown wrapped around a food product 100. The food product includes an edible outer layer 102 surrounding an edible filling 104. The package 98 comprises a microwave transparent wrapper 106 and a number of conducting strips or wires 108 formed or embedded in wrapper 106. The strips 108 extend longitudinally between two probes 110 which are inserted through the wrapper 106 into the ends of the food product 100. The probes 110 are made of an electrically conductive material, such as metalized plastic, and include a head 112 connected to a transverse shank 114 having a preferably pointed end 116.

During packaging of the food product 100 with the package 98, the end flaps 118 of the wrapper 106 are closed over the ends of the food product 100 and the probes 110 are inserted into the ends of the food product so that the head 112 contacts one or more strips 108 and the shank 114 contacts the filling 104. In this manner, the strips 108 will receive a portion of the microwave energy and convert it into a current and the probes 110 will direct the current into and across the filling 104 to heat the filling. At the same time, the remainder of the microwave energy will pass through the wrapper 106 and heat the food product 100 from the outside in.

The probes 110 are preferably adhered to the wrapper 106 so that they may be removed from the food product 100 when the wrapper 106 is removed. Alternatively, the probes 110 may be bonded to the wrapper 106 during construction of the wrapper 106.

Figure 12:
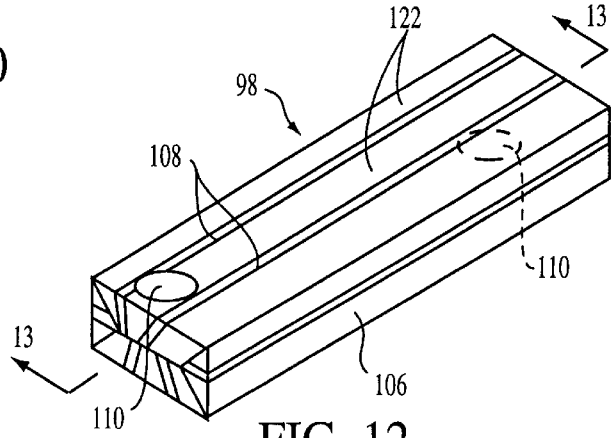
FIG. 12 is a perspective view of a food product shown wrapped in another embodiment of a package of the present invention.
Figure 13:
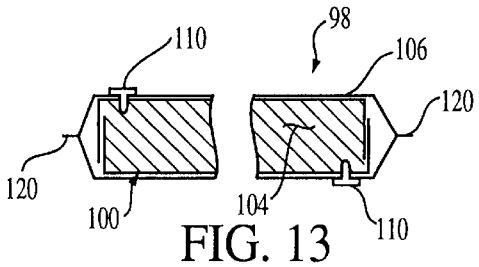
FIG. 13 is a longitudinal cross-sectional view of the food product and package taken along line 13—13 of FIG. 12.

The embodiment of the package 98 depicted in FIGS. 12 and 13 is similar to the embodiment depicted in FIGS. 10 and 11. In this embodiment, however, the ends 120 of the wrapper 106 are crimped together by, for example, the crimping heads of a conventional wrapping machine. Accordingly, the probes 110 may be more conveniently inserted into the food product 100 adjacent to, rather than directly in, its ends. In addition, the conductive strips 108 are wider than the strips 108 depicted in FIG. 10. The strips 108 of this embodiment are accordingly designed to couple more of the microwave energy into the filling 104 and allow a proportionately lesser amount of microwave energy to pass through the wrapper 106 to the food product 100. The dimensions of the strips 108 and the adjacent microwave transparent apertures 122 between the strips 108 will be dictated by the food product 100 and the desired internal versus external heating required to cook the food product. Furthermore, other configurations for the strips 108 and the apertures 122 may be employed. For example, the apertures 122 may be circles or slots formed in an electrically conductive layer of wrapper 106.

Figure 14:
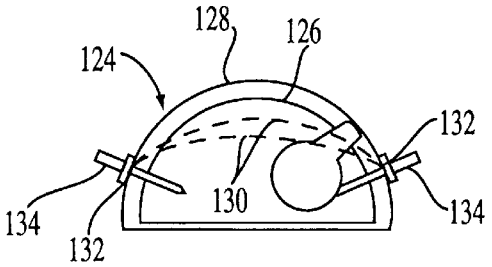
FIG. 14 is a cross-sectional view of another embodiment of the present invention shown operatively combined with a food product.
Figure 15:
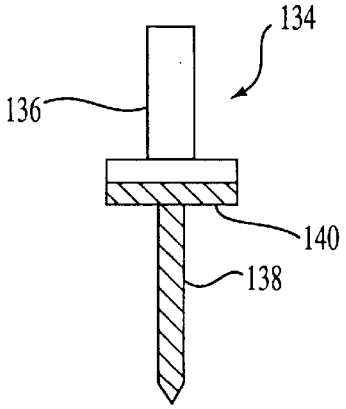
FIG. 15 is an enlarged cross-sectional view of the probe portion of the invention depicted in FIG. 14.

Referring now to FIGS. 14 and 15, the device of the present invention may also take the form of a container 124 in which a food product to be cooked, such as a chicken 126, is placed. The container 124 comprises a bag 128 which is constructed of a microwave transparent material, such as plastic, and includes a number of conductive strips 130 formed therein. The strips 130 extend longitudinally between two poles 132 positioned at opposite ends of the bag 128. A probe 134 is inserted through each pole 132 and into the chicken 126. The probes comprise a preferably plastic handle 136 connected to a metallic shank 138 having a metallic head 140. Accordingly, when the probes 134 are inserted through the bag 128 into the chicken 126, the head 140 will contact the strips and the shank 138 will couple the strips into the interior of the chicken 126. In this manner, when the container 124 is exposed to microwave radiation, the strips 130 will receive a portion of the microwaves and convert them into and across a current which will be conducted into the interior of the chicken 126 by the probes 134. The interior of the chicken 126 between the probes 134 will thus be resistively heated while the remainder of the microwaves will pass through the bag 128 and cook the chicken 126 from the outside in. If desired, the bag 128 may be provided with one or more apertures to allow steam or heat to escape from the bag 128.

Figure 16:
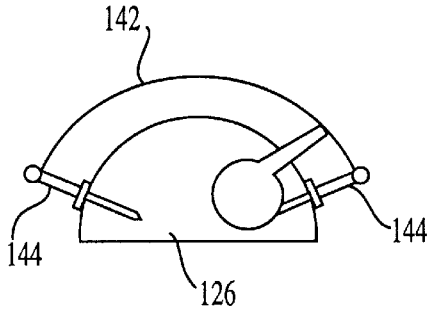
FIG. 16 is a cross-sectional view of another embodiment of the present invention shown operatively connected to a food product.
Figure 17:
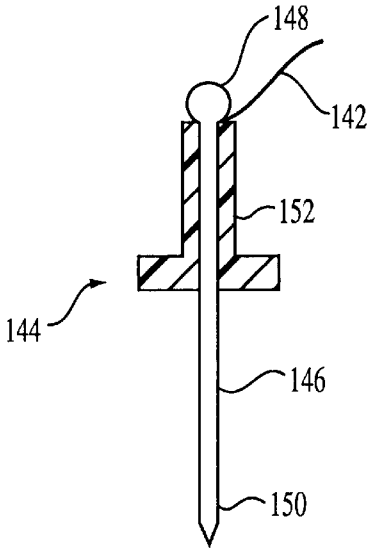
FIG. 17 is an enlarged cross-sectional view of the probe portion of the invention depicted in FIG. 16.

Referring to FIGS. 16 and 17, another embodiment of the present invention is shown operatively connected to a food product, such as a chicken 126. The device of this embodiment is adapted to facilitate the cooking of the chicken 126 without having to place the chicken 126 in a wrapper or bag. Accordingly, the device comprises one or more conductive wires 142 extending between two probes 144. Each probe 144 comprises a metallic shank 146 having a first end 148 to which the wires 142 are connected and a second end 150 which is adapted to be inserted into the chicken 126. Each probe 144 also preferably comprises a plastic handle 152 connected to the shank 146 between the first and second ends 148, 150. When exposed to microwave radiation, the wires 142 will receive a portion of the microwave radiation and convert it into current which the probes 144 will then conduct into and across the chicken 126. The remainder of the microwave radiation will pass directly to the chicken 126. In this manner, the interior of the chicken between the probes 144 will be resistively heated while the exterior of the chicken will be heated by the microwave radiation.

While the wires 142 are designed to receive the microwave energy, the probes 144 could also be designed to perform this function. Thus, the shank 146 could be designed as an antenna which would itself receive a portion of the microwaves.

It should be recognized that, while the present invention has been described in relation to the preferred embodiments thereof, those skilled in the art may develop a wide variation of structural and operational details without departing from the principles of the invention. For example, the various components illustrated in the different embodiments may be combined in a manner not illustrated above. Therefore, the appended claims are to be construed to cover all equivalents falling within the true scope and spirit of the invention.

What is claimed is:

1. A device for facilitating the heating of a food product having an interior and an exterior, the device comprising:

means for receiving microwave energy generated by a microwave source and converting the microwave energy into an electric current; and at least first and second opposing coupling means in contact with both the receiving and converting means and respective spaced apart portions of the food product located between said coupling means for coupling the current across the interior between said spaced apart portions of the food product;

whereby a portion of the interior of the food product between the coupling means is resistively heated.

2. device of claim 1, wherein the receiving and converting means comprises a package for the food product which comprises an electrically conductive material and each coupling means comprises a probe extending between the electrical conductive material and the interior of the food product.

3. A method of heating a food product having an exterior and an interior, the method comprising:

receiving microwave energy generated by a microwave source;

converting the microwave energy into electrical current; and providing at least first and second opposing coupling means in contact with spaced apart portions of the food product located between said coupling means for coupling the electrical current across the interior between said spaced apart portions of the food product;

wherein the electrical current is conducted through the interior of the food product solely by the food product so that a portion of said interior is resistively heated.

4. The device of claim 2, wherein the package comprises an electrically conductive material substantially shielding the exterior of the food product from the microwave energy.

5. The device of claim 4, wherein the package further comprises means for directing the current toward the probes.

6. The device of claim 5, wherein the package comprises at least first and second electrically conducting sheets and the directing means comprises an electrically insulating strip connected between the sheets.

7. The device of claim 4, further comprising means positioned between a portion of the package adjacent each probe and the exterior of the food product for electrically insulting the exterior of the food product from the electric current.

8. The device of claim 7, wherein the insulating means comprises an electrically insulating disc which is adapted to allow the probe to pass therethrough.

9. The device of claim 4, wherein the package comprises an outer electrically conductive layer and an inner electrically insulating layer and the probes extend between the conductive layer and the interior of the food product adjacent the spaced apart portions, whereby the exterior of the food product is substantially shielded from the microwave energy and insulated from the current.

10. The device of claim 9, wherein the package further comprises means for directing the current toward the probes.

11. The device of claim 10, wherein the package comprises at least first and second electrically conducting sheets and the directing means comprises an electrically insulating strip connected between the sheets.

12. The device of claim 2, wherein the package comprises a microwave transparent wrapper and at least one electrically conductive element extending between the probes, wherein the package permits a portion of the microwave energy to heat the exterior of the food product.

13. The device of claim 12 wherein the conductive element comprises a conductive strip formed on the wrapper.

14. The device of claim 1, wherein the receiving and converting means comprises at least one electrically conductive element and the coupling means comprises at least two probes which are adapted to engage the interior of the food product adjacent the spaced apart portions.

15. The device of claim 14, wherein the electrically conductive element comprises an electrically conducting wire and each probe comprises an electrically conducting shank having a first end which is connected to the wire and a second end which is adapted to be inserted into the food product.

16. The device of claim 14, wherein the receiving and converting means comprises a container for the food product and the conductive element comprises a conductive strip formed on the container.

17. A method of preparing a food product having an inner edible core and an outer edible layer surrounding the core, the method comprising:

enclosing the food product in a container constructed of an electrically conductive material;

providing at least first and second opposing coupling means in contact with the container and said inner edible core for electrically coupling the container with at least two spaced apart portions of the inner edible core located between said coupling means; and exposing the container with the food product therein to microwave energy;

converting the microwave energy into electrical current on the container;

conducting the electrical current from said container through the inner edible core between the spaced apart portions using the inner edible core as an electrical conductor;

wherein the outer edible layer is shielded from the microwave energy; and wherein the inner edible core is resistively heated to a temperature greater than the temperature of the outer layer.

18. The method of claim 17, further comprising freezing at least the outer layer of the food product prior to exposing the container to microwave energy.

19. The method of claim 18, further comprising providing an edible insulating layer between the core and the outer layer.

20. The method of claim 18, further comprising insulating the outer layer from the container.

* * * * *